United States Patent [19]

Hayano et al.

[11] Patent Number: 4,762,477

[45] Date of Patent: Aug. 9, 1988

[54] SCROLL COMPRESSOR WITH CONTROL OF LUBRICANT FLOW

[75] Inventors: Makoto Hayano; Shigemi Nagatomo, both of Tokyo; Hirotsugu Sakata, Kanagawa; Mitsuo Hatori, Yokohama, all of Japan

[73] Assignee: Kabushiki Kaisha Toshiba, Kawasaki, Japan

[21] Appl. No.: 913,349

[22] Filed: Sep. 30, 1986

[30] Foreign Application Priority Data

Sep. 30, 1985 [JP] Japan ..... 60-214954

[51] Int. Cl.[4] ..... F04C 18/04; F04C 29/02

[52] U.S. Cl. ..... 418/1; 418/55; 418/88; 418/94

[58] Field of Search ..... 418/55, 57, 88, 94; 184/6.16, 6.18

[56] References Cited

U.S. PATENT DOCUMENTS 4,522,575 6/1985 Tischer et al. ..... 418/55

FOREIGN PATENT DOCUMENTS 3341637 6/1984 Fed. Rep. of Germany ..... 418/94
56-85087 12/1981 Japan .
58-160582 9/1983 Japan ..... 418/88
58-214692 12/1983 Japan ..... 418/55
59-119090 7/1984 Japan ..... 418/94

*Primary Examiner*—John J. Vrablik
*Attorney, Agent, or Firm*—Foley & Lardner, Schwartz, Jeffery, Schwaab, Mack, Blumenthal & Evans

[57] ABSTRACT

A scroll compressor has a channel formed in a compressor member such as main shaft, frame, orbital scroll member, through which lubricating oil can pass easily from the higher pressure side to the lower pressure side under flow control between sliding surfaces of the compressor members without reduction in the sealing between the higher pressure side and the lower pressure side, whereby injecting sufficient lubricating oil between the scroll members improves both the sealing and the lubricating between the scroll members.

21 Claims, 10 Drawing Sheets

SCROLL COMPRESSOR WITH CONTROL OF LUBRICANT FLOW

BACKGROUND OF THE INVENTION

1. Field of the Invention

The present invention is related to a scroll compressor, specifically an improvement in sealing and lubricating between stationary and orbital scroll members of the compressor.

2. Description of the Related Art

A scroll compressor has a pair of stationary and orbital scroll members inside a sealed vessel, with plural compression chambers formed between them. Since these compression chambers are at high pressure, the orbital scroll member is inclined to be pushed away from the stationary scroll member. Consequently, a gap is formed between the scroll members, and leakage occurs between adjacent compression chambers. A method of preventing this is given in, for example, Japanese Utility Model Publication of Unexamined Application No. SHO-56-85087. In this method, high pressure gas forced out of a compression chamber is guided below the orbital scroll member, that is, to the side away from the stationary scroll member, and supports the orbital scroll member by pushing it against the stationary scroll member. In other words, the stationary scroll member is fixed to a frame inside the sealed vessel, while the orbital scroll member is pinched between this stationary scroll member and a protrusion integrally formed on the frame. Coolant gas which is sucked into the compression chamber between a stationary scroll member and an orbital scroll member from a suction pipe is compressed by the rotary motion of the orbital scroll member and so is brought to high pressure, and is forced out to the interior of the sealed vessel through the ejection port in the stationary scroll member. It will be noted that the interior of the scroll compressor is essentially divided into a higher pressure side exposed to the high pressure gas ejected from the compression chambers and a lower pressure side exposed to the suction gas.

The inside, that is, the center, of the frame protrusion contains the main rotation shaft of the orbital scroll member. High pressure gas is guided into it and reaches the same high pressure as the higher pressure side of the sealed vessel. This causes the orbital scroll member to be pushed upward against the resistance of the pressure inside the compression chambers, so that gaps do not occur between the orbital scroll member and the stationary scroll member. Then, to make the sliding of the orbital scroll member against the stationary scroll member smooth, lubricating oil sucked up by the pumping action of the main shaft in the vicinity of the rear surface of the orbital scroll member moves past the frame protrusion due to the pressure difference and enters the spaces between the scroll members.

However, only a slight amount of the lubricating oil adhered to the vicinity of the frame protrusion enters the lower pressure side due to the pressure difference while the lubricating oil which is sucked up by the pumping action of the main shaft in the vicinity of the orbital scroll member does not sufficiently enter the spaces between the scroll members, which are at low pressure, so that the spaces between the scroll members are neither sufficiently sealed nor sufficiently lubricated, causing the capacity of the pressure to drop.

For this reason, a configuration has been described in U.S. Pat. Ser. No. 4,522,575 in which lubricant is supplied directly to the compression chambers through a suction pipe. However, in this configuration, a separate means is needed to control the amount of lubricant.

PURPOSE OF THIS INVENTION

One purpose of this invention is to provide a scroll compressor of improved compression efficiency in which lubricating oil can pass easily from the higher pressure side to the lower pressure side without reduction in the sealing between the higher pressure side and the lower pressure side. By injecting sufficient lubricating oil between the scroll members, both the sealing and the lubricating between the scroll members are improved.

Another purpose of this invention is to provide a scroll compressor in which a controlled amount of lubricant is supplied to the interior of the compression chambers without need to provide a separate control mechanism.

In order to achieve these purposes, in the scroll compressor of this invention, lubrication oil pumped up by the main shaft is supplied through a channel either to the top surface of the frame protrusion which partitions the rear surface of the orbital scroll member into the higher and lower pressure sides, or directly to the lower pressure side.

EMBODIMENTS OF THIS INVENTION

Figure 1:
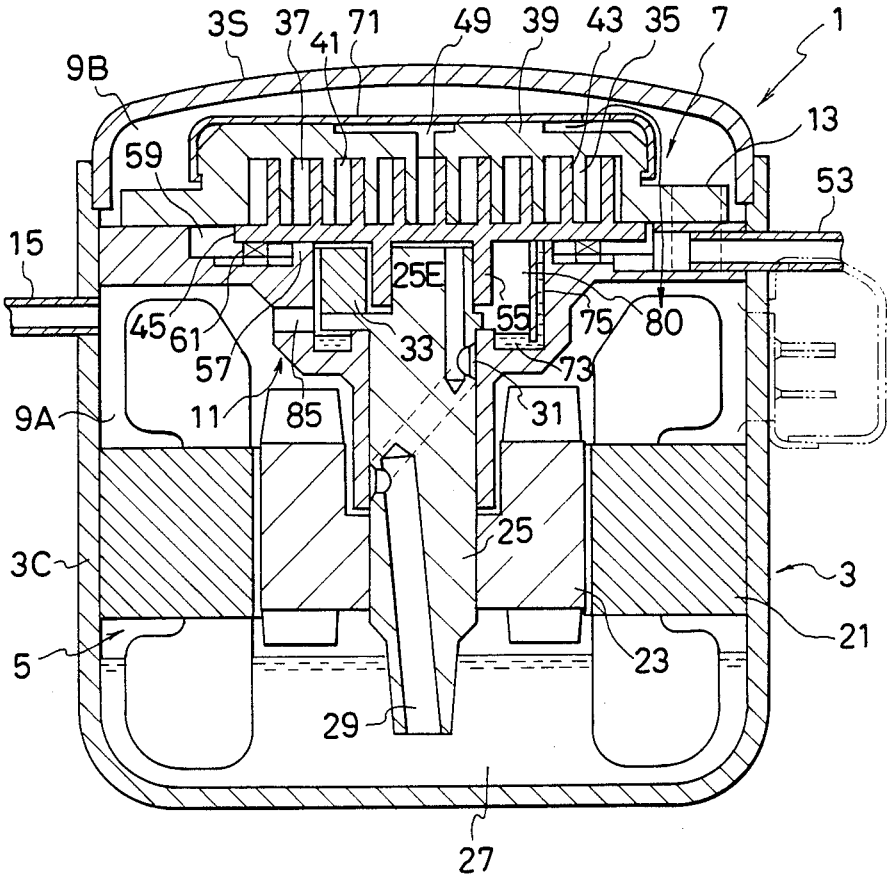
FIG. 1 is a vertical cross-sectional view of a scroll compressor which is an embodiment of this invention.

Referring to FIG. 1, which shows a preferred embodiment of this invention, the scroll compressor which is identified overall as 1 comprises a sealed vessel 3, and a rotation drive device 5 such as a motor and a compression device 7 for compressing gas, which are contained inside the sealed vessel 3.

The sealed vessel 3 has a cylindrical casing 3C with bottom and a sealing cover 3S which is fixed to the casing 3C so that the vessel is sealed. A generally disc-shaped frame 11 which partitions the interior of the sealed vessel 3 into a drive chamber 9A and a compression device chamber 9B is solidly fixed to the vessel 3. A connecting hole 13 which connects the drive chamber 9A and the compression device chamber 9B is opened in this frame 11. In addition, an exhaust tube 15 is formed in the sealed vessel 3 at a location remote from the connecting hole 13.

The rotation drive device 5 has a motor. Its stator iron core 21 is integrally attached to the casing 3C inside the said drive chamber 9A, and the rotor 23 is integrally attached to the main or rotating shaft 25 which is supported vertically by the center part of the said frame 11 so that it is free to rotate. The bottom end of the rotation shaft 25 is immersed in lubricating oil which collects in the lubricating oil well 27 inside the bottom of the casing 3C. The core of this rotation shaft 25 has a lubricating oil suction hole 29, which sucks lubricating oil during rotation, inclined at an appropriate angle to the core of the shaft. This suction hole 29 connects to relevant parts such as the frame 11 in order to send lubricating oil to the bearings and to the compression device 7. In addition, the top end of the rotating shaft 25 has an eccentric section 25E which is displaced an appropriate amount from the center of the rotation shaft 25 formed in it, and a balancer 33 is attached off-center as necessary to balance the eccentric section 25E to minimize vibrations.

In the configuration as mentioned above, when the rotation shaft 25 is rotating, lubricating oil is automatically supplied to parts where it is needed such as the bearings, so that smooth motion is maintained.

The compression device 7 is located in the compression device chamber 9B. It comprises the disc-shaped stationary end plate 39 to which the stationary scroll wrap 35 is integrally formed and the disc-shaped orbital end plate 45 to which the orbital scroll wrap 43, which slides against the stationary scroll wrap 35 at a plurality of locations thus forming compression chambers at a plurality of locations.

The stationary end plate 39 is sealingly fixed to the frame 11. An ejection port 49 through which high-pressure gas that has been compressed is ejected into the compression device chamber 9B is opened in the approximate center of the stationary end plate 39. The end plate 39 includes another opening 82 through which high-pressure gas exits on its way via hole 13 into the drive chamber 9A (as shown by the arrow in FIG. 1). In addition, the suction pipe 53 is connected to the frame 11. The stationary scroll wrap 35 and the stationary end plate 39 together form the stationary scroll member; the orbital scroll wrap 43 and the orbital end plate 45 and the mating section 55, which are to be discussed below, together form the orbital scroll member.

The orbital end plate 45, as shown in FIG. 1, is mated with the stationary end plate 39. A plurality of compression chambers 41 are formed by the sliding of the orbital scroll wrap 43 against the stationary scroll wrap 35 at a plurality of locations. The cylindrically-shaped mating section 55 is formed in the center of the rear or bottom side of the orbital end plate 45. The eccentric section 25E of the rotation shaft 25 is mated to the inside of this mating section 55 so that it is free to rotate. In addition, the rear surfaces of the plate 45 is supported by the top surface of an annular protrusion 57 formed on the frame 11 so that they are free to rotate. The protrusion defines a slidably engaging portion with the mating surface portion of the orbital end plate, and can be formed on the orbital end plate instead of on the frame. A low pressure chamber 59 which is connected to the suction chamber 37 is formed an the outside of the protrusion 57. An Oldham's ring 61 is installed within this low pressure chamber 59. A cover plate 71 is attached to the stationary end plate 39. It muffles the sound when high pressure gas is ejected from the ejection port 49, and also prevents high pressure gas from impacting directly on the sealing cover 3S. It will be noted that the sealed vessel has essentially a lower pressure side or section including the low pressure chamber 59 and a higher pressure side or section exposed to the high pressure gas.

The Oldham's ring 61 keeps the directionality of the orbital end plate 45 with respect to the stationary end plate 39 fixed at all times. A lower protrusion (omitted from the figure) is formed in the lower surface of the Oldham's ring 61, and an upper protrusion (omitted from the figure) at a right angle to the lower protrusion is formed in the upper surface. The lower protrusion of this Oldham's ring 61 is coupled to a guide groove formed in the bottom of the low pressure chamber 59 so that it is free to slide, while the upper protrusion is coupled to a guide groove formed in the rear surface of the orbital end plate 45 so that it is free to slide.

Figure 2:
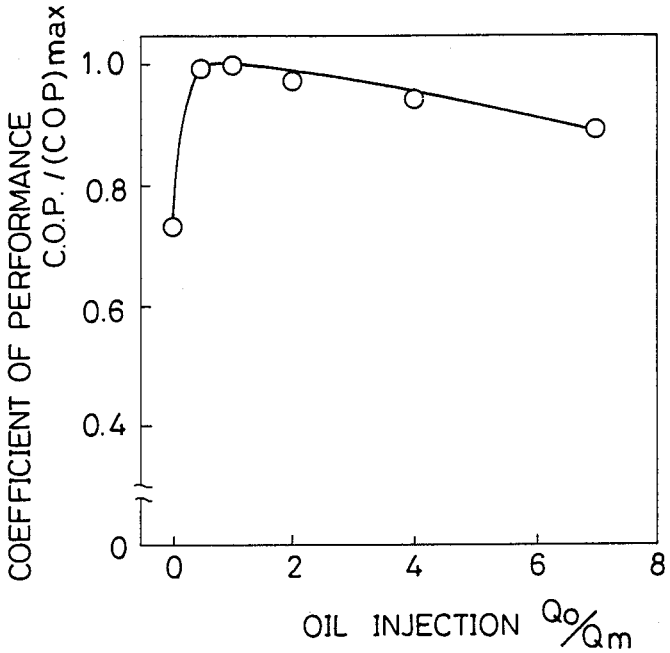
FIG. 2 is a graph which shows the relationship between the nondimensionalized oil injection amount and the coefficient of performance.

As stated above, in order to form good seals betwen the stationary scroll member and the orbital scroll member and to keep them sliding against each other smoothly, lubricating oil has been supplied to the pressure chamber, but it is discovered that, as shown in FIG. 2, if the amount of lubricant supplied is excessive, the compressor capacity decreases.

FIG. 2 shows the amount of oil injected as the abscissa versus the coefficient of performance of the compressor as the ordinate. For the sake of nondimensionalization, the amount of oil injected is expressed as the ratio of the actual amount $\theta_0$ of oil injected to the amount $\theta_m$ of oil injected when the coefficient of performance is a maximum; the coefficient of performance is expressed as the ratio of the actual coefficient of performance C.O.P. to the maximum coefficient of performance C.O.P.max.

In this invention, lubricant is supplied to the low pressure section on the rear side or bottom side of the orbital scroll member. Lubricant is then supplied from there to the compression chambers. This invention is based on the fact that if the compressor components in the supply path, for example, the protrusion 57 and the Oldham's ring 61, are utilized as means of limiting the flow, then even if a separate means of limiting the flow is not provided, the amount of lubricant supplied will be limited to a desirable level.

In the configuration in FIG. 1, a depression 73 is formed in the frame 11 around the rotation shaft 25. A channel or conduit 75 extends from this depression 73 to the upper surface of the protrusion 57 of the frame 11. The channel 75 can be installed in a plurality of locations.

In the configuration in FIG. 1, when the rotation shaft 25 is rotated by the rotation drive device 5, the eccentric section 25E of the rotation shaft 25 rotates eccentrically. Consequently the orbital end plate 45 rotates while their directionality is held fixed by the Oldham's ring 61. The scroll wrap 43 attached to the orbital end plate 45 is displaced up, down, left and right. At this time, when the orbital scroll wrap 43 is rotated, the plurality of sliding positions between the orbital scroll wrap 43 attached to the orbital end plate 45 and the stationary scroll wrap 35 attached to the stationary end plate 39 gradually move from the outside toward the inside, so that the compression chambers 41 are gradually compressed. Consequently, the gas inside the compression chambers 41 is compressed, and ejected from the ejection port 49 into the compression device chamber 9B.

The high-pressure gas which is ejected into the compression device chamber 9B passes through the connecting hole 13 into the drive chamber 9A, specifically the higher pressure side, and is exhausted to the outside from the exhaust tube 15.

The lubricating oil 27 which has collected in the bottom of the casing 3C is pumped up to the supply port 31 by the rotary pump action of the main shaft 25, lubricates all around the main shaft 25 and collects in the depression 73 in the frame 11. On the rear surface of the orbital end plate 45, with the protrusion 57 of the frame 11 as a boundary, the higher pressure of ejected gas is applied to the inside, and the lower pressure of suctioned gas is applied to the outside. The existence of this pressure difference across the protrusion 57 and the movement of the orbital end plate 45 on the upper surface of the protrusion 57 cause the lubricating oil in the depression 73 to be sucked up into the channel 75 and supplied to the low pressure chamber 59 which is on the lower pressure side. It enters the spaces between the scroll members together with suctioned gas, increasing the compression capacity. In addition, since lubricating oil is sucked up onto the top surface of the protrusion, this top surface acts to limit the flow and also improves the seal between the higher pressure side and the lower pressure side.

The eccentric section 25E of the rotation shaft 25 is contained in a space 80, which is communicated with the drive chamber 9A through a hole 85. If the hole 85 were not there, the space 80 would fill up with oil and the supply of oil by the main shaft would not take place, making the lubrication of the sliding surfaces of the main shaft inadequate. The hole 85 enables excess oil to return to the bottom of the case, improving the circulation of oil and eliminating the problem of inadequate lubrication. In addition, since the center-offset balancer 33 rotates in the space 80, if oil is present, it will cause friction loss; the hole 85 eliminates that loss.

Figure 3:
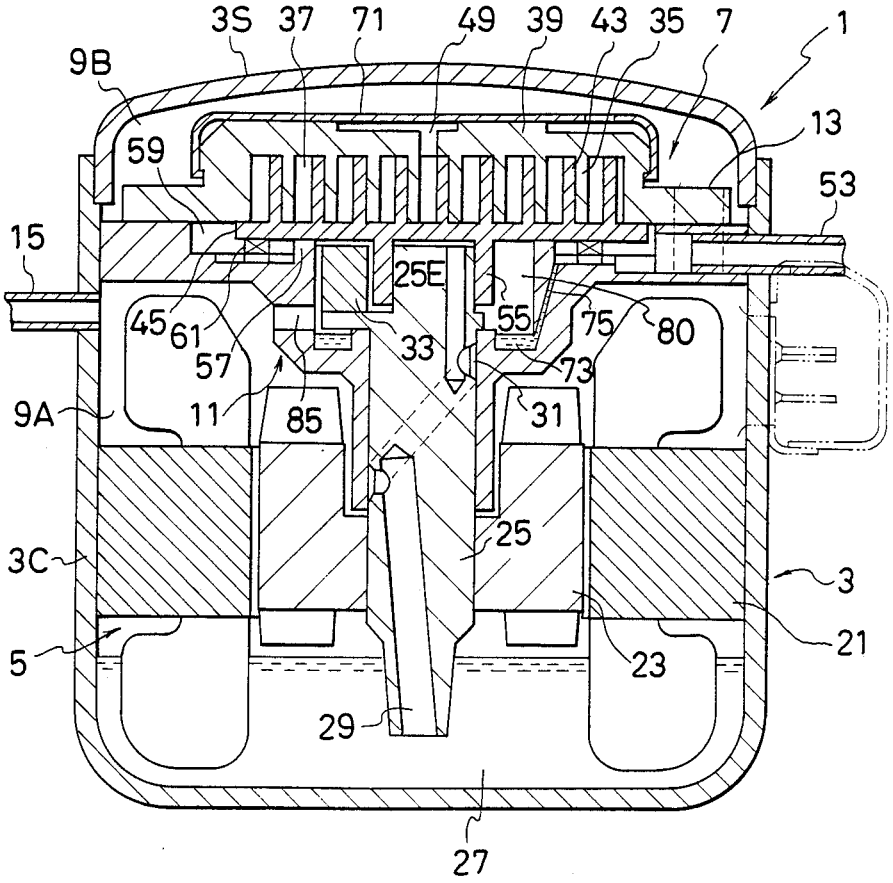
FIG. 3 is a vertical cross-sectional view of a scroll compressor which is another embodiment of this invention.

In FIG. 3, the channel 75 is introduced at a location where it faces the low pressure chamber 59 of the frame 11, connecting the space between the protrusion 57 and the Oldham's ring 61 with the oil well 73, and the pressure difference supplies lubricating oil directly to the low pressure chamber 59. In this case, the Oldham's ring acts to limit the flow.

Figure 4:
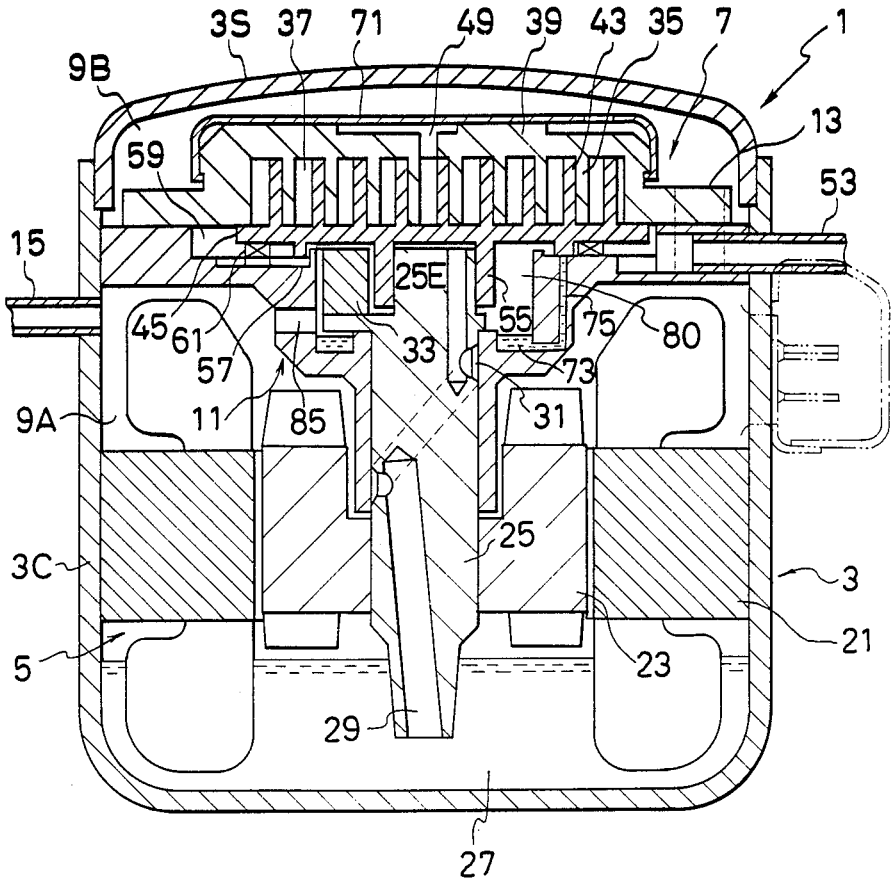
FIG. 4 is a vertical cross-sectional view of a scroll compressor which is another embodiment of this invention.

In FIG. 4, there is a protrusion formed on the orbital scroll end plate and there is a channel 75 which is communicated alternately with the top surface of the protrusion and with the low pressure section as the orbital scroll member rotates. The channel 75 can also be made to be open only to either the top surface of the protrusion or the low pressure section.

Figure 5:
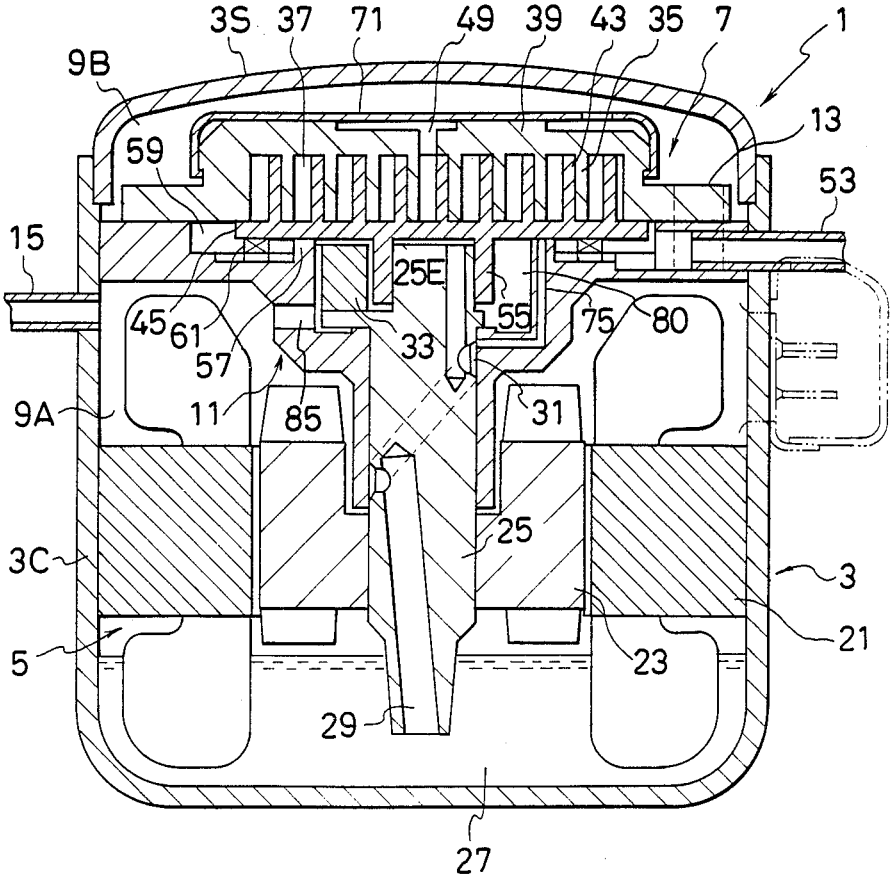
FIG. 5 is a vertical cross-sectional view of a scroll compressor which is another embodiment of this invention.

In FIG. 5, there is a channel 75 which communicates the top portion of the main bearing with the frame protrusion. Part of the oil which is pumped up by the main shaft oil suction hole is guided to the protrusion and supplied to the spaces between the scroll members. In this case, an oil well depression is not necessary.

Figure 6:
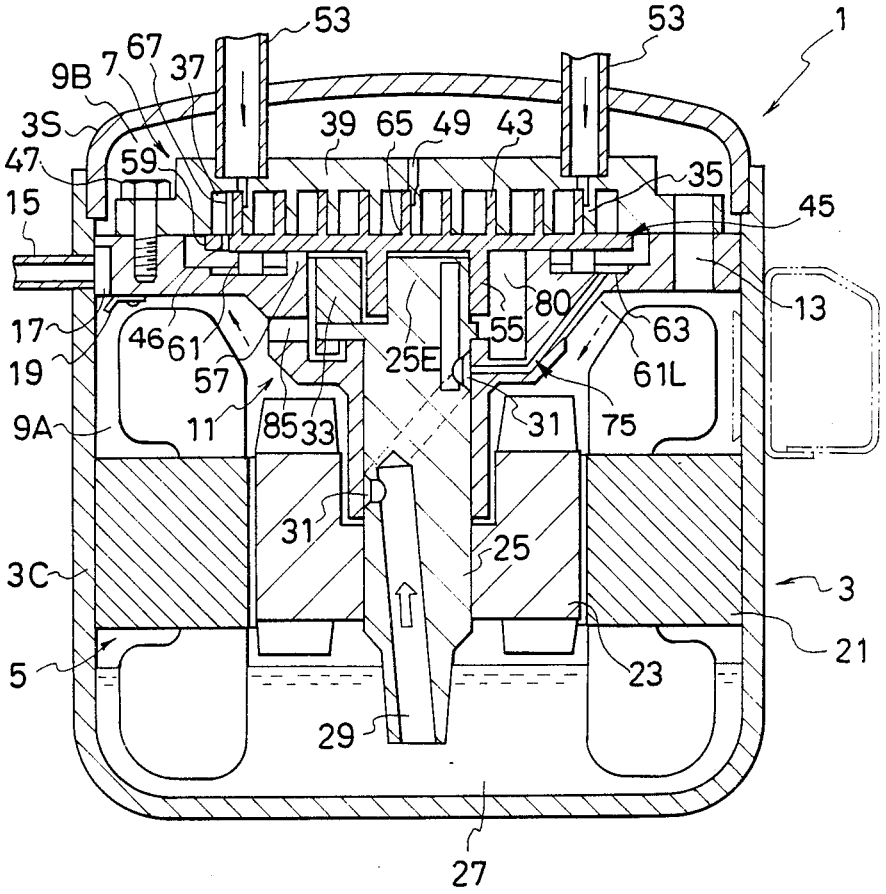
FIG. 6 is a vertical cross-sectional view of a scroll compressor which is another embodiment of this invention.

In FIG. 6, part of the oil which is pumped up by the main shaft screw pump is guided to the lower pressure side of the outside of the Oldham's ring.

In this case the flow is limited by a hole 46 formed in the orbital end plate 45 and opened and closed corresponding to the action of the moving scroll member. Again, an oil well depression is not necessary in this embodiment.

Figure 7:
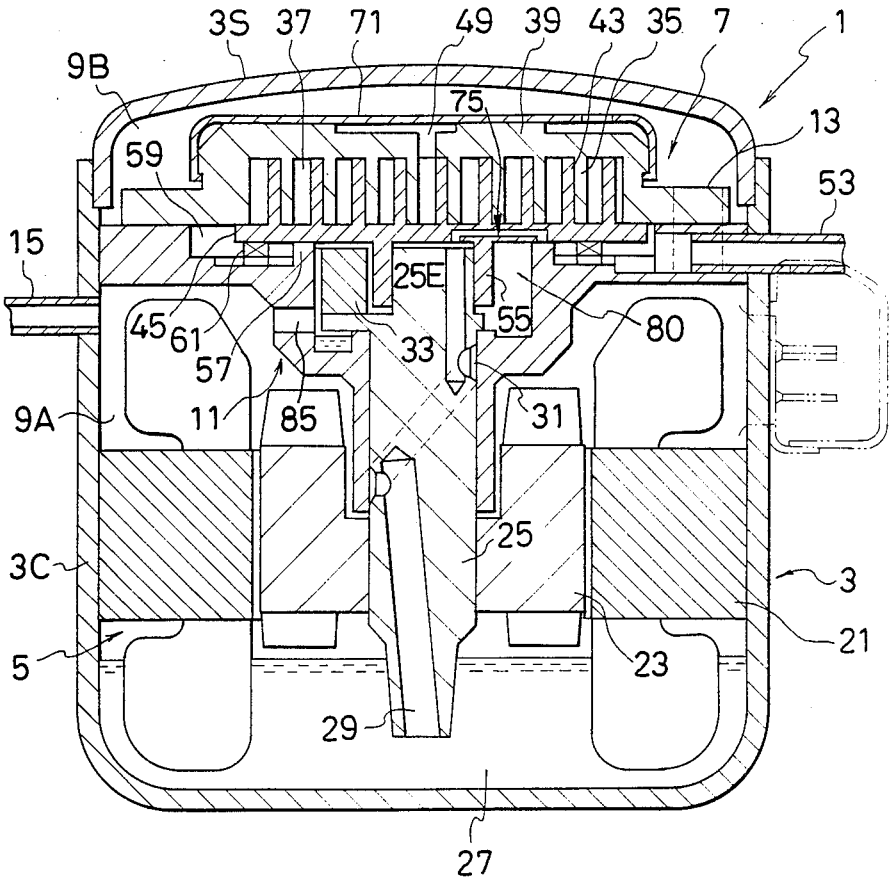
FIG. 7 is a vertical cross sectional view of a scroll compressor which is another embodiment of this invention.

In FIG. 7, there is a channel 75 that communicate the boss section with the top surface of the protrusion inside the orbital end plate. It is also possible to have the low pressure side temporarily communicated with the boss section as the orbital scroll member rotates, or to have the low pressure section permanently communicated with the boss section. Oil which is pumped up by the crankshaft viscous pump is injected.

Figure 8:
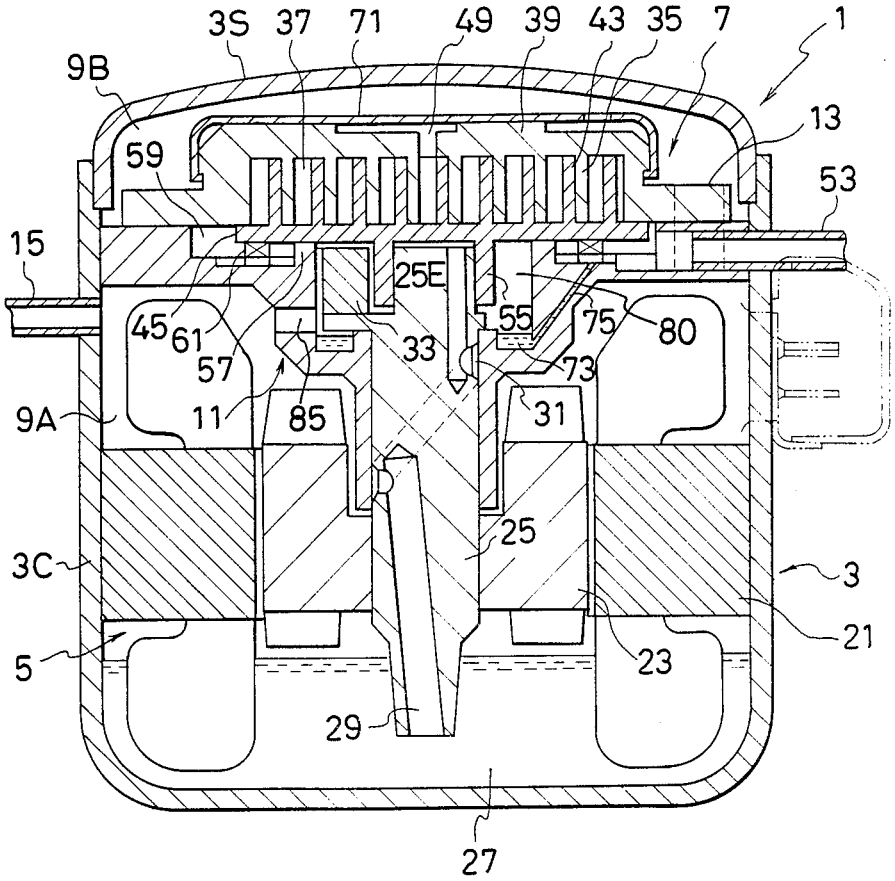
FIG. 8 is a vertical cross-sectional view of a scroll compressor which is another embodiment of this invention.

In FIG. 8, a channel 75 communicates the Oldham's ring key side surface with a frame oil well. The reciprocating motion of the key controls the amount of oil supplied, and an appropriate amount of oil is injected. This also improves the lubrication of the key. It is also possible to have channels connecting to a plurality of locations on the side surface of the key.

Figure 9:
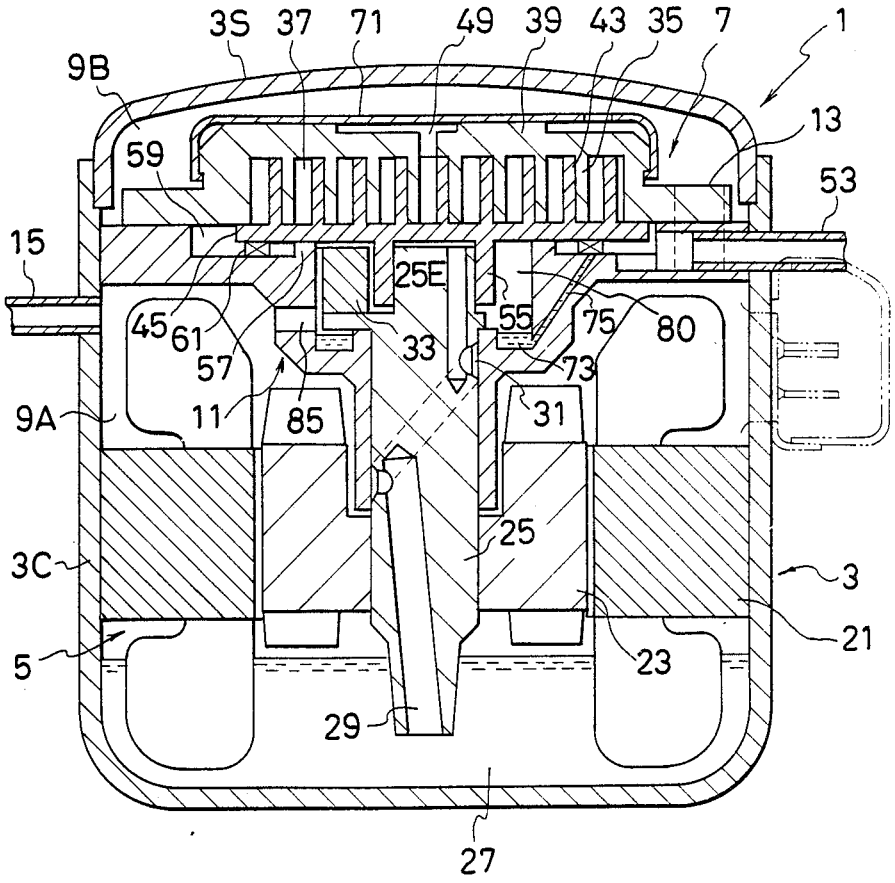
FIG. 9 is a vertical cross-sectional view of a scroll compressor which is another embodiment of this invention.

In FIG. 9, a channel 75 communicates the frame sliding part of the Oldham's ring to the frame oil well. The reciprocating motion of the Oldham's ring controls the amount of oil supplied, so that an appropriate amount of oil can be injected. In addition, this improves the lubrication of the Oldham's ring in the thrust direction at the sliding section. It is also possible to connect to a plurality of locations below the Oldham's ring.

Figure 10:
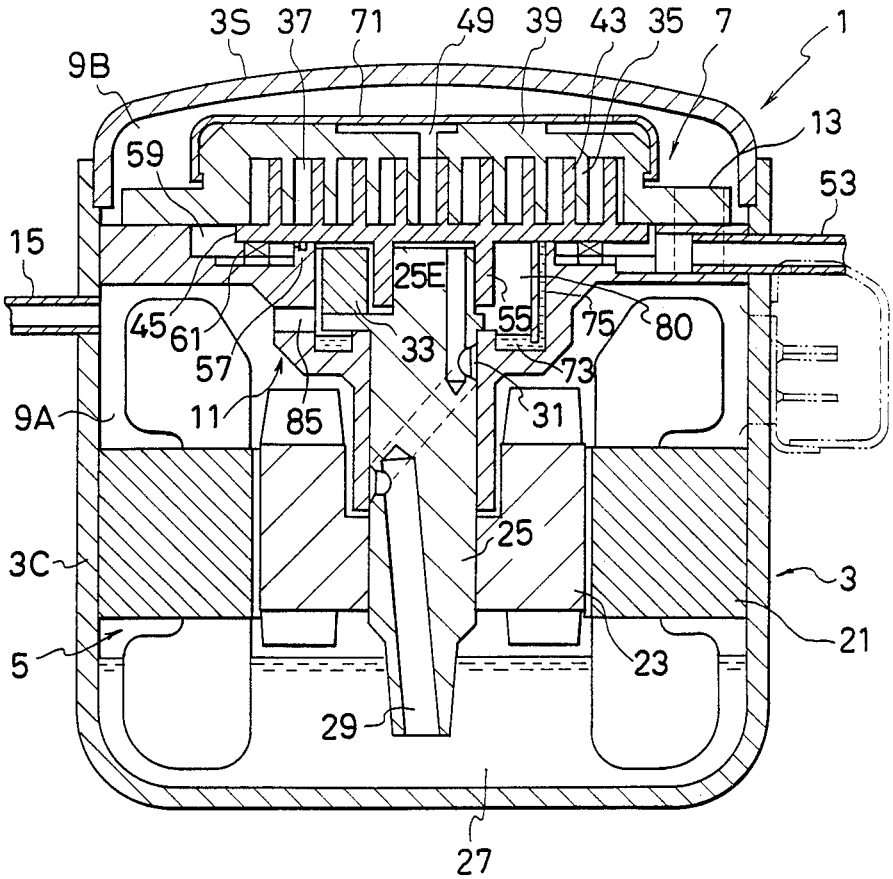
FIG. 10 is a vertical cross-sectional view of a scroll compressor which is another embodiment of this invention.
Figure 11:
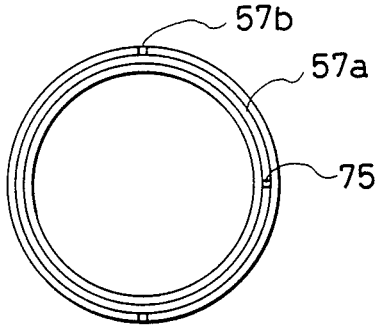
FIG. 11 is a view which shows the top surface of a protrusion in the embodiment in FIG. 10.

In FIG. 10, an annular groove **57*a* is cut in the protrusion 57 as shown in FIG. 11. A channel 75 connects to this annular groove. One or more ejection grooves 57*b*** are cut in the radial direction from this annular groove so that lubricant is sent to the lower pressure side.

In summary, in this invention, compressor components on the rear side of the orbital scroll member are used as means to control the flow of lubricant. By doing this and using the pressure difference between the higher pressure side and the lower pressure side to supply lubricating oil to the lower pressure side, lubricating oil can be supplied stably to the spaces between the orbital scroll member and the stationary scroll member, improving both sealing and capacity while maintaining adequate lubrication.

What is claimed is:

1. A method of limiting the flow of lubricating oil in a process for operating a scroll compressor comprising a sealed vessel having a low-pressure gas suction section and a high-pressure gas ejection section; a frame which is fixed to the inside of the sealed vessel; a stationary scroll member fixed to the frame and having a stationary scroll wrap; an orbital scroll member placed between the stationary scroll member and the frame and slidably supported on a first side thereof on said frame through a slidably engaging portion and having an orbital scroll wrap on the other side;

a lubricating oil well in a lower part of said vessel which contains lubricating oil; a rotating shaft having one end connected to the orbital scroll member so as to rotate the orbital scroll member and the other end immersed in the lubricating oil well; and a lubricating oil suction hole which passes through the rotating shaft, said method comprising the steps of forcibly supplying lubricating oil sucked up through the lubricating oil suction hole through a separate oil supply channel to the low-pressure gas suction section by the high pressure which is produced by the compression action between the orbital and stationary scroll members, and at the same time controlling the flow of the lubricating oil through said channel to the low-pressure gas suction section by metering the oil flow by at least one metering member located between said frame and the first side of said orbital scroll member.

2. A method as claimed in claim 1, wherein said metering member comprises said slidably engaging portion.

3. A method as claimed in claim 2, wherein said metering member comprises an Oldham's ring.

4. A scroll compressor comprising a sealed vessel which has a low-pressure gas suction and a high-pressure gas ejection section; a frame which is fixed to the inside of the sealed vessel; a stationary scroll member fixed to the frame and having a scroll wrap; an orbital scroll member having first and second sides, located between the stationary scroll member and the frame and supported through a slidably engaging portion formed between the first side of the orbital scroll member and the frame, wherein compression chambers are formed between the second side of the orbital scroll member and the stationary scroll member, and the first side of said orbital scroll member is partitioned into a higher pressure side and a lower pressure side by the slidably engaging portion; a lubricating oil well in a lower part of said vessel which contains lubricating oil; a rotating shaft having one end connected to the orbital scroll member to rotate the orbital scroll member in order to compress the gas in the compression chambers and the other end immersed in the lubricating oil well; a lubricating oil suction hole which passes through the rotating shaft; and a means, comprising a separate oil flow channel, for communicating the lubricating oil suction hole to at least one location on the lower pressure side on the first side of the orbital scroll member via a metering member located between said frame and the first side of said orbital scroll member, said metering member metering oil flow to the lower pressure side.

5. A scroll compressor as described in claim 4 wherein the slidably engaging portion is formed by an annular protrusion formed on one of the frame and the orbital scroll member.

6. A scroll compressor as described in claim 4 in which the communicating means comprises a channel which extends from the main shaft screw pump the top surface of the annular protrusion.

7. A scroll compressor as described in claim 4 in which the communicating is made on the radially inside of an Oldham's ring used on the said lower pressure side and said metering member comprises said Oldham's ring.

8. A scroll compressor as described in claim 4 in which the said oil suction hole is engaged with a boss section of the oribtal scroll member and the channel of the communicating means extends from the said boss section.

9. A scroll compressor as described in claim 4 in which the channel of said communicating means is communicated with the key side surface of an Oldham's ring.

10. A scroll compressor as described in claim 4 in which the channel of said communicating means is communicated with the location where an Oldham's ring slides against the frame.

11. A scroll compressor as described in claim 4 in which an annular groove is cut in the top surface of the protrusion, the channel of said communicating means is communicated with the annular groove, the annular groove has at least one radial ejection groove for ejection of the lubricating oil from the said ejection groove to the lower pressure side.

12. A scroll compressor, comprising:

a sealed vessel having a higher pressure side exposed to high pressure gas and a lower pressure side exposed to suction gas;

a frame fixed to the sealed vessel;

a stationary scroll member connected to the frame;

an orbital scroll member having a mating section, the orbital scroll member being adapted to engage with the stationary scroll member;

a protrusion positioned between the frame and the orbital scroll member, the protrusion defining a slidably engaging position for supporting the orbital scroll member;

a rotation shaft for rotating the orbital scroll member, the rotation shaft having an eccentric section adapted to mate with the mating section of the orbital scroll member and an oil supply pump, the rotation shaft being supported within a shaft receiving portion of the frame;

means for rotating the rotation shaft;

means separate from the shaft receiving portion of the frame for guiding lubricant from the rotation shaft to the slidably engaging portion; and means, including said protrusion, for metering a desirable amount of lubricant supplied by said lubricant guiding means to the lower pressure side of the orbital and stationary scroll members.

13. A scroll compressor as described in claim 12, further comprising a depression formed in said frame on the higher pressure side which serves as a well for lubricating oil and is communicated with the slidably engaging portion and the lower pressure side.

14. A scroll compressor as described in claim 12, wherein the slidably engaging portion is made by a top surface of a protrusion formed on one of the lower surface of the orbital scroll member and the upper surface of the frame.

15. A scroll compressor as described in claim 14 wherein an annular oil groove is cut on the top surface of the protrusion.

16. A scroll compressor as described in claim 15, wherein there is at least one groove extending from the annular oil groove on the protrusion in the radial direction toward the lower pressure side.

17. A scroll compressor as described in claim 12 wherein a lubricating oil well depression is formed in the frame near the slidably engaging portion so that it receives the high pressure of the compressed gas, and the communicating means are provided for communicating the said lubricating oil well depression with the slidably engaging portion.

18. A scroll compressor comprising a sealed vessel, a frame fixed to the inside of the sealed vessel, a stationary scroll member fixed to the upper surface of the frame and an orbital scroll member which meshes with the stationary scroll member to form pressure chambers and has a cylindrical portion extending from the lower-side opposite to the stationary scroll member, the sealed vessel being divided into a higher pressure side which is exposed to high pressure gas ejected from the compression chambers and a lower pressure side which is exposed to low pressure gas entering said pressure chambers, the lower side of the orbital scroll member having a surface which is partitioned into the higher pressure side and the lower pressure side by an annular, slidably engaging portion defined by a protrusion integrally formed on one of the upper surface of the frame and the lower surface of the orbital scroll member and a surface portion of the other of the upper surface of the frame and the lower surface of the orbital scroll member, the orbital scroll member being support through the slidably engaging portion, a main shaft having a portion received in the cylindrical portion to contact and slide against a mating section formed in the center of the lower surface of the orbital scroll member within the cylindrical portion, a drive device for rotating the main shaft, the main shaft having an oil supply pump formed therein by which lubricating oil is pumped out of a lower portion of the vessel, and a means, including a separate oil flow channel, for guiding the lubricating oil pumped up by the said pump to the slidably engaging portion where the lower surface of the orbital scroll member slides against the frame, whereby said annular, slidably engaging portion meters delivery of lubricating oil to said lower pressure side of said vessel.

19. A scroll compressor as described in claim 18, wherein the oil supply pump formed in the main shaft is communicated directly via said channel with the slidably engaging portion.

20. A scroll compressor as described in claim 19, wherein said oil flow channel connects with the oil supply pump at the mating section formed on the lower surface of the orbital scroll member and passes through the orbital scroll member to the slidably engaging portion.

21. A scroll compressor as described in claim 18 wherein at least part of the lower pressure side opening of the channel is displaced from the slidably engaging portion during operation.

* * * * *